US011525237B2

(12) United States Patent
Legatt

(10) Patent No.: US 11,525,237 B2
(45) Date of Patent: Dec. 13, 2022

(54) LOADER BUCKET

(71) Applicant: Clark Equipment Company, West Fargo, ND (US)

(72) Inventor: Jason Legatt, Bismarck, ND (US)

(73) Assignee: Clark Equipment Company, West Fargo, ND (US)

( * ) Notice: Subject to any disclaimer, the term of this patent is extended or adjusted under 35 U.S.C. 154(b) by 404 days.

(21) Appl. No.: 16/555,473

(22) Filed: Aug. 29, 2019

(65) Prior Publication Data

US 2020/0071907 A1 Mar. 5, 2020

Related U.S. Application Data

(60) Provisional application No. 62/725,797, filed on Aug. 31, 2018.

(51) Int. Cl.

| | |
|---|---|
| ***E02F 3/40*** | (2006.01) |
| ***E02F 9/28*** | (2006.01) |
| ***E02F 3/36*** | (2006.01) |

(52) U.S. Cl.

CPC ..... *E02F 3/40* (2013.01); *E02F 3/3604* (2013.01); *E02F 9/2883* (2013.01)

(58) Field of Classification Search

CPC ..... E02F 3/40; E02F 3/3604; E02F 9/2883

See application file for complete search history.

(56) References Cited

U.S. PATENT DOCUMENTS

| | | | | |
|---|---|---|---|---|
| 3,093,917 | A * | 6/1963 | Schroeder | E02F 3/401 37/444 |
| 3,109,248 | A * | 11/1963 | Vos | E02F 3/401 37/408 |
| 4,523,397 | A * | 6/1985 | Lucas | E02F 3/401 37/444 |
| 5,267,402 | A * | 12/1993 | Russell | E02F 3/40 37/379 |
| 6,186,735 | B1 * | 2/2001 | Deyo | E02F 3/40 414/722 |
| 10,024,027 | B2 * | 7/2018 | Worth | E02F 3/40 |
| 10,662,610 | B2 * | 5/2020 | Rupp | E02F 3/40 |
| 2006/0182590 | A1 * | 8/2006 | McFarland | E02F 3/40 414/685 |
| 2018/0058034 | A1 * | 3/2018 | Worth | E02F 3/40 |
| 2019/0136484 | A1 * | 5/2019 | Rupp | E02F 3/40 |
| 2019/0316318 | A1 * | 10/2019 | Cantu | E02F 3/401 |
| 2020/0071907 | A1 * | 3/2020 | Legatt | E02F 3/3604 |

* cited by examiner

*Primary Examiner* — Jamie L McGowan

(74) *Attorney, Agent, or Firm* — John Veldhuis-Kroeze; Westman, Champlin & Koehler, P.A.

(57) ABSTRACT

Power machine bucket implements include a rear wall structure, a bottom wall structure adjoining the rear wall structure at a bend region, and a two-piece brace. The two-piece brace includes a first piece attached to and extending along a portion of the bottom wall structure and a second piece, separate from the first piece, attached to the back side of the rear wall structure.

14 Claims, 6 Drawing Sheets

LOADER BUCKET

CROSS-REFERENCE TO RELATED APPLICATION

This application claims the benefit of U.S. Provisional Application No. 62/725,797, which was filed on Aug. 31, 2018.

BACKGROUND

The present disclosure is related to implements and accessories for implements that are attachable to power machines. More particularly, the present disclosure is related to implements or implement accessories that include a loader bucket.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Some examples of work vehicle power machines include loaders, excavators, utility vehicles, tractors, and trenchers, to name a few.

One common type of implement is a bucket which can be mounted on an implement carrier of a power machine such as a loader. In use, buckets frequently encounter contact with obstacles. Such encounters can apply a shock load to the bucket. These shock loads can wear portions of the bucket, cause stress failures of bucket components such as the implement carrier interface, etc. Further, even normal operation such as digging can also cause wear to portions of the bucket and fatigue of the implement carrier interface.

The discussion in this Background is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter.

Disclosed embodiments include a bucket implement for power machines, such as loaders, and a brace configuration which provides increased strength to the implement carrier interface and provides increased wear resistance. One general aspect includes a power machine bucket implement (100; 100'; 100"; 200), including: a rear wall structure (202); a bottom wall structure (204) adjoining the rear wall structure at a bend region (206); a two-piece brace (230) including a first portion (232) attached to and extending along a portion of the bottom wall structure (204) and a second portion (234) attached to the back side of the rear wall structure (202).

Implementations may include one or more of the following features. The implement where the second portion (234) of the two-piece brace (230) extends along a horizontal portion of the back side of the rear wall structure (202). The implement where the second portion (234) of the two-piece brace (230) extends horizontally along at least half of the back side of the rear wall structure (202). The implement where the implement carrier interface (220) includes first and second engagement portions (222; 224) providing first and second lip portions (226; 228) extending away from the back side of the rear wall structure (202), and where the second portion (234) of the two-piece brace (230) extends along the horizontal portion of the back side of the rear wall structure (202) beneath the first and second lip portions of the implement carrier interface. The implement where the first and second lip portions (226; 228) of the implement carrier interface are spaced apart, and where the second portion (234) of the two-piece brace (230) extends an entire width between the spaced apart first and second lip portions. The implement where the second portion (234) of the two-piece brace (230) extends from an outer edge of the first lip portion (226) to an outer edge of the second lip portion (228). The implement and further including an l-bracket (207) secured to the bottom wall structure (204) and to the rear wall structure (202) at a bend region (206) between the bottom wall structure and the rear wall structure. The implement where the second portion (234) of the two-piece brace (230) includes: a tab portion (242) configured to be received in a slot formed in the rear wall structure (202); and horizontally extending portions (240) extending laterally from the tab portion and configured to interface and be attached to the rear wall structure or the l-bracket (207), where the horizontally extending portions include first and second end portions (244; 246) configured to be attached to the first and second lip portions (226; 228) of the implement carrier interface (220).

One general aspect includes a power machine bucket implement (100; 100'; 100"; 200), including: a rear wall structure (202); a bottom wall structure (204) adjoining the rear wall structure at a bend region (206); a first side wall structure (208) adjoining the rear wall structure at a first edge (212) and adjoining the bottom wall structure at a second edge (214); a second side wall structure (210) adjoining the rear wall structure at a third edge (216) and adjoining the bottom wall structure at a fourth edge (218); an implement carrier interface (220) attached to a back side of the rear wall structure (202) and configured to mate with an implement carrier of a power machine, the implement carrier interface including first and second engagement portions (222; 224) providing first and second lip portions (226; 228) extending away from the back side of the rear wall structure (202); a two-piece brace (230) including a first portion (232) attached to and extending along a portion of the bottom wall structure (204) and a second portion (234) attached to the back side of the rear wall structure (202) and to a bottom portion of the implement carrier interface (220).

Implementations may include one or more of the following features. The implement where the second portion (234) of the two-piece brace (230) extends along a horizontal portion of the back side of the rear wall structure (202) beneath the first and second lip portions of the implement carrier interface. The implement where the first and second lip portions (226; 228) of the implement carrier interface are spaced apart, and where the second portion (234) of the two-piece brace (230) extends an entire width between the spaced apart first and second lip portions. The implement where the second portion (234) of the two-piece brace (230) extends from an outer edge of the first lip portion (226) to an outer edge of the second lip portion (228). The implement where the second portion (234) of the two-piece brace (230) includes: a tab portion (242) configured to be received in a slot formed in the rear wall structure (202); and horizontally extending portions (240) extending laterally from the tab portion and configured to interface and be attached to the rear wall structure, where the horizontally extending portions include first and second end portions (244; 246)

configured to be attached under first and second lip portions (226; 228) of the implement carrier interface (220).

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

Disclosed concepts are used to reinforce and protect a loader bucket to prevent wear and/or fatigue failure of bucket components such as the implement interface, the bucket bottom, and the bucket cutting edge. Disclosed embodiments are described with respect to loader buckets, but can be used on other buckets such as utility vehicle buckets.

Disclosed concepts can be practiced on various implements and various power machines, as will be described below. Representative implements 100, 100', 100" on which the embodiments can be practiced and representative power machines 10 and 10' to which the implement can be operably coupled are illustrated in diagram form in FIGS. 1-3 and described below before any embodiments are disclosed. For the sake of brevity, only one implement and power machine combination is discussed in detail. However, as mentioned above, the embodiments below can be practiced on any of a number of implements and these various implements can be operably coupled to a variety of different power machines. Power machines, for the purposes of this discussion, include a frame, in some instances at least one work element, and a power source that is capable of providing power to the work element to accomplish a work task. One type of power machine is a self-propelled work vehicle. Self-propelled work vehicles are a class of power machines that include a frame, work element, and a power source that is capable of providing power to the work element. At least one of the work elements is a motive system for moving the power machine under power.

Figure 1:
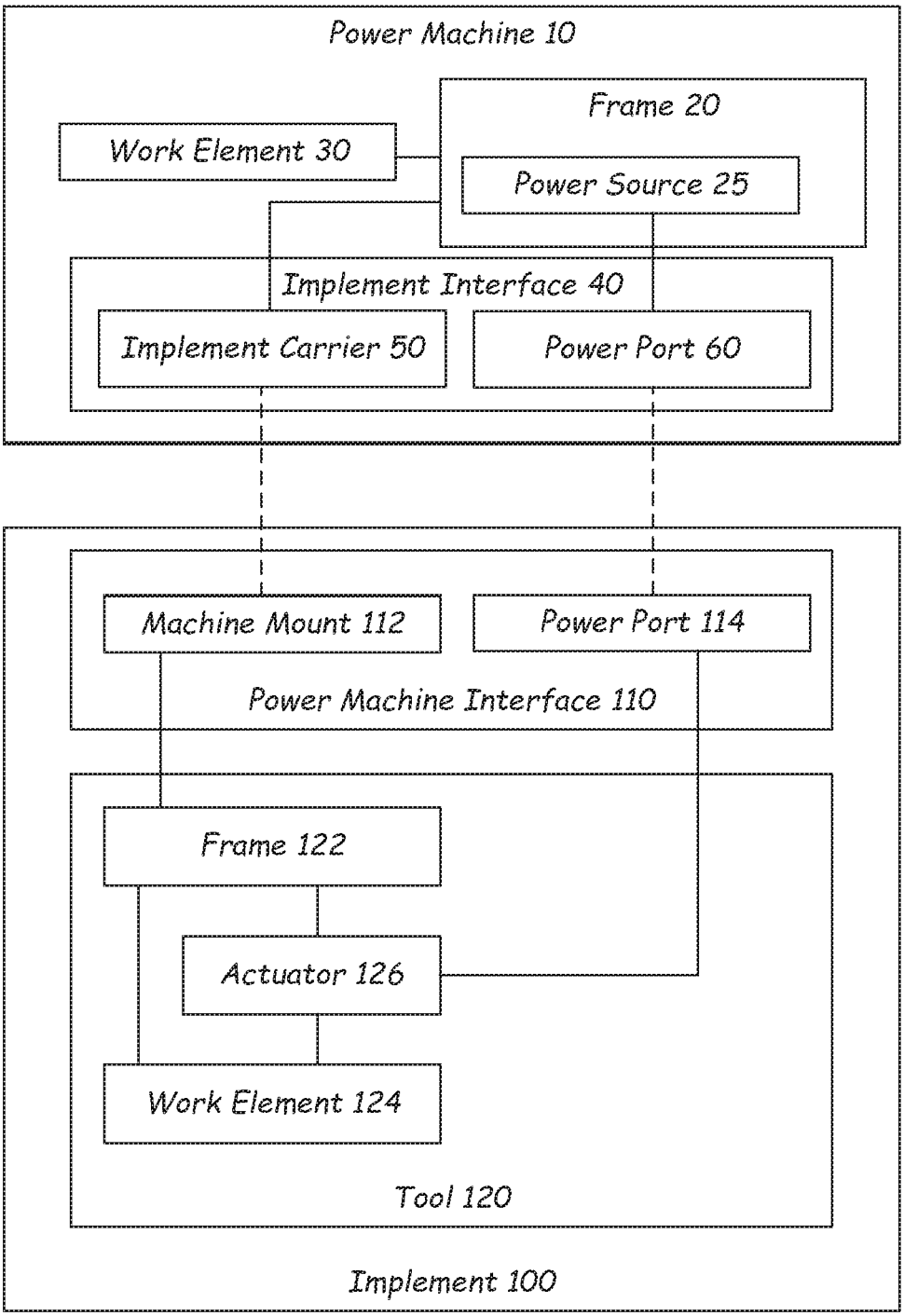
FIGS. 1-3 are each block diagrams illustrating functional systems of a representative implement on which embodiments of the present disclosure can be practiced and a power machine to which the representative implement can be coupled.

Referring now to FIG. 1, a block diagram illustrates basic systems of power machine 10 as are relevant to interact with implement 100 as well as basic features of implement 100, which represents an implement upon which the embodiments discussed below can be advantageously incorporated. At their most basic level, power machines for the purposes of this discussion include a frame 20, a power source 25, a work element 30, and, as shown in FIG. 1, an implement interface 40. On power machines such as loaders and excavators and other similar work vehicles, implement interface 40 includes an implement carrier 50 and a power port 60. The implement carrier 50 is typically rotatably attached to a lift arm or another work element and is capable of being secured to the implement. The power port 60 provides a connection for the implement 100 to provide power from the power source to the implement. Power source 25 represents one or more sources of power that are generated on power machine 10. This can include either or both of pressurized fluid and electrical power.

The implement 100, which is sometimes known as an attachment or an attachable implement, has a power machine interface 110 and a tool 120, which is coupled to the power machine interface 110. The power machine interface 110 illustratively includes a machine mount 112 and a power port 114 for coupling with power machine 10. Machine mount 112 can be any structure capable of being coupled to the implement interface 40 of power machine 10. Power port 114, in some embodiments, includes hydraulic and/or electrical couplers. Power port 114 can also include a wireless electrical connection, as may be applicable on a given implement. While both machine mount 112 and power port 114 are shown, some implements may have only one or the other as part of their power machine interface 110. Other implements, such as a bucket and some simple forklifts, would not have a power port 114 at all (e.g., See FIG. 3). Some other forklifts may have an actuator for adjusting its tines vertically, horizontally, rotationally, or by extending them in response to power signals received from the power machine 10 at power port 114.

In instances where a power machine has a specific implement carrier, the machine mount 112 will include a structure that complements the specific implement carrier. For power machines without an implement carrier, the machine mount includes features to directly mount the implement 100 to the power machine 10 such as bushings to accept pins for mounting the implement to a lift arm and an actuator for moving the implement.

For the purposes of this discussion, implements can be categorized as simple or complex. A simple implement has no actuated work element. One example of a simple implement is a bucket or a forklift without actuable tines. A complex implement has at least one actuable work element such as a forklift with actuable tines. Complex implements are further divided into those that have one actuable work element and those that have multiple work elements. Some complex implements include features of a simple implement.

In FIG. 1, the implement 100 illustrates a tool 120 for a complex implement with a single work element 124. The tool 120 includes a frame 122, which is coupled with or integral to the machine mount 112. A work element 124 is coupled to the frame 122 and is moveable in some way (vertical, horizontal, rotation, extension, etc.) with respect to the frame. An actuator 126 is mounted to the frame 122 and the work element 124 and is actuable under power to move the work element with respect to the frame. Power is provided to the actuator 126 via the power machine. Power is selectively provided in the form of pressurized hydraulic fluid (or other power source) directly from the power machine 10 to the actuator 126 via power ports 60 and 114.

Figure 2:
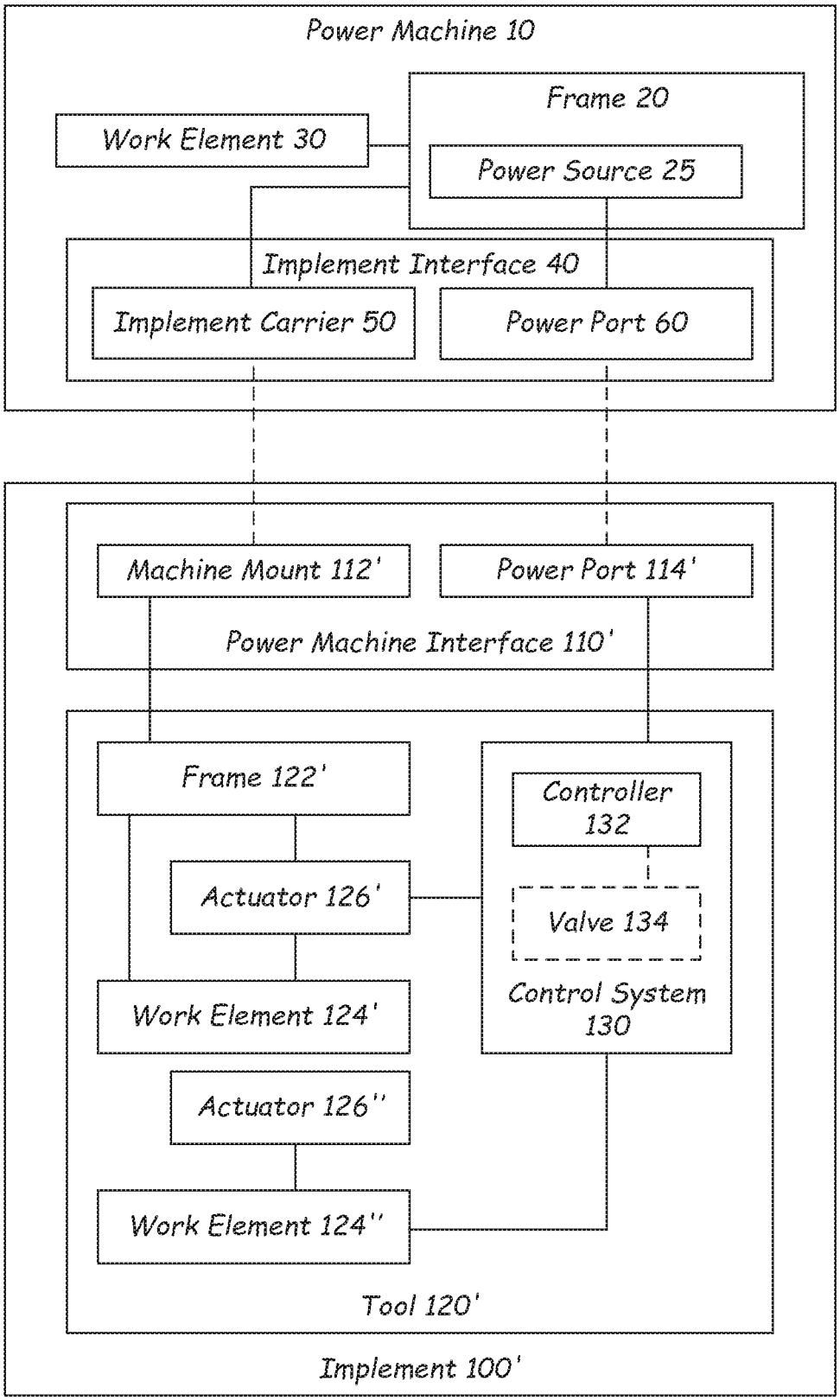

FIG. 2 illustrates an implement 100', which depicts a complex, multi-function implement. The features in FIG. 2 that are similarly numbered to those in FIG. 1 are substantially similar and are not discussed again here for the sake of brevity. Implement 100' has one or more additional work elements 124", which are shown in block form. Each work element 124" has a corresponding actuator 126" coupled thereto for controlling movement of the work element 124". A control system 130 receives power from the power machine and selectively provides power to the actuators 126' and 126" in response to signals from operator inputs. The control system 130 includes a controller 132, which is configured to receive electrical signals from the power machine 10 indicative of operator input manipulation and control power to the various actuators based on those electrical signals. The controller 132 can provide electrical signals to some or all of the actuators 126' and 126" to control their function. Alternatively, the controller 132 can control optional valve 134, which in turn controls actuation of some or all of the actuators 126' and 126" by providing pressurized hydraulic fluid to the actuators.

Although not shown in FIG. 2, in some instances, controller 132 can receive signals indicative of operator actuation of user inputs that are mounted on the implement, as opposed to the power machine. In these applications, the implement is controlled from an operator position that is located remotely from the power machine (i.e. next to the implement 100').

Figure 3:
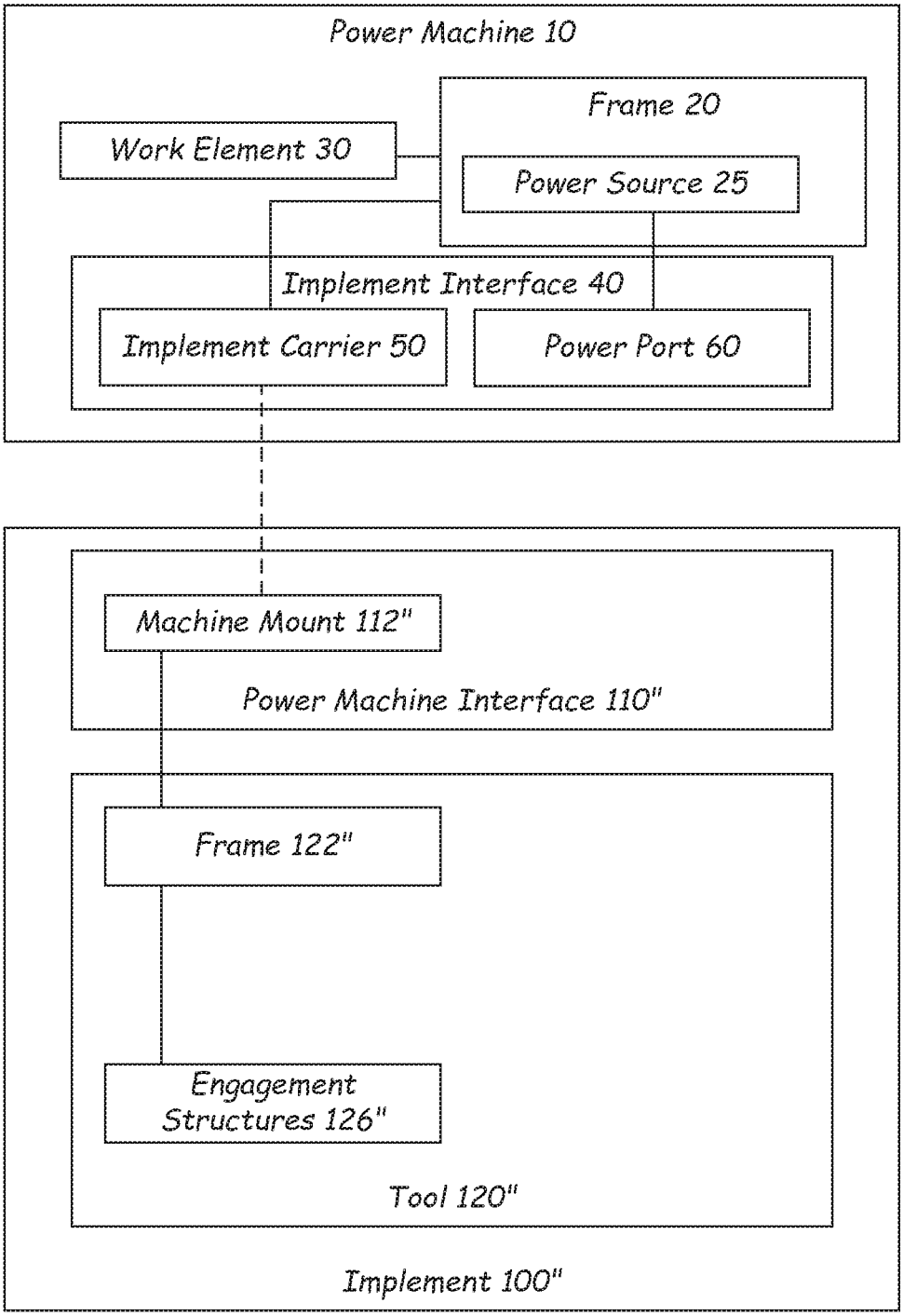

FIG. 3 illustrates an implement 100", which depicts a simple implement. The features in FIG. 3 that are similarly numbered to those in FIG. 1 are substantially similar and are not discussed again here for the sake of brevity. Implement 100" has one or more engagement structures 126" that is fixedly or moveably attached to the frame 122". Unlike a work element, which is powered by an actuator to move relative to the frame to perform a work function, the engagement structure can engage a medium to perform, in combination with the power machine, work. For example, a simple bucket has an engagement structure including a cutting edge and a defined volume that holds soil or material that is collected into a bucket. As another example, tines of a forklift can be mounted to the frame of the forklift implement for engaging a pallet. Such tines can be adjustable, but in many cases, the tines themselves are not moveable under power to perform work, but are instead engagement structures for engaging and supporting a load to be lifted and/or carried.

A power machine interface can include a machine mount in the form of a generally planar interface plate that is capable of being coupled to an implement carrier on a loader. In embodiments, various types of machine mounts can be employed. The power machine interface can also include a power port (e.g., see interfaces 110 and 110' of FIGS. 1 and 2 respectively), or not such as with the power machine interface 110" of FIG. 3. When the power machine interface includes a power port, the power port can include hydraulic conduits that are connectable to conduits on a power machine so that pressurized hydraulic fluid can be selectively provided to an actuator on the implement to actuate a connected working element. The power port can also include an electrical connection, which can be connectable to a controller (such as controller 132 of FIG. 2) and actuators on a valve (such as valve 134). The controller and valve can be included in a control system (such as control system 130) on the implement for controlling functions thereon.

Figure 4:
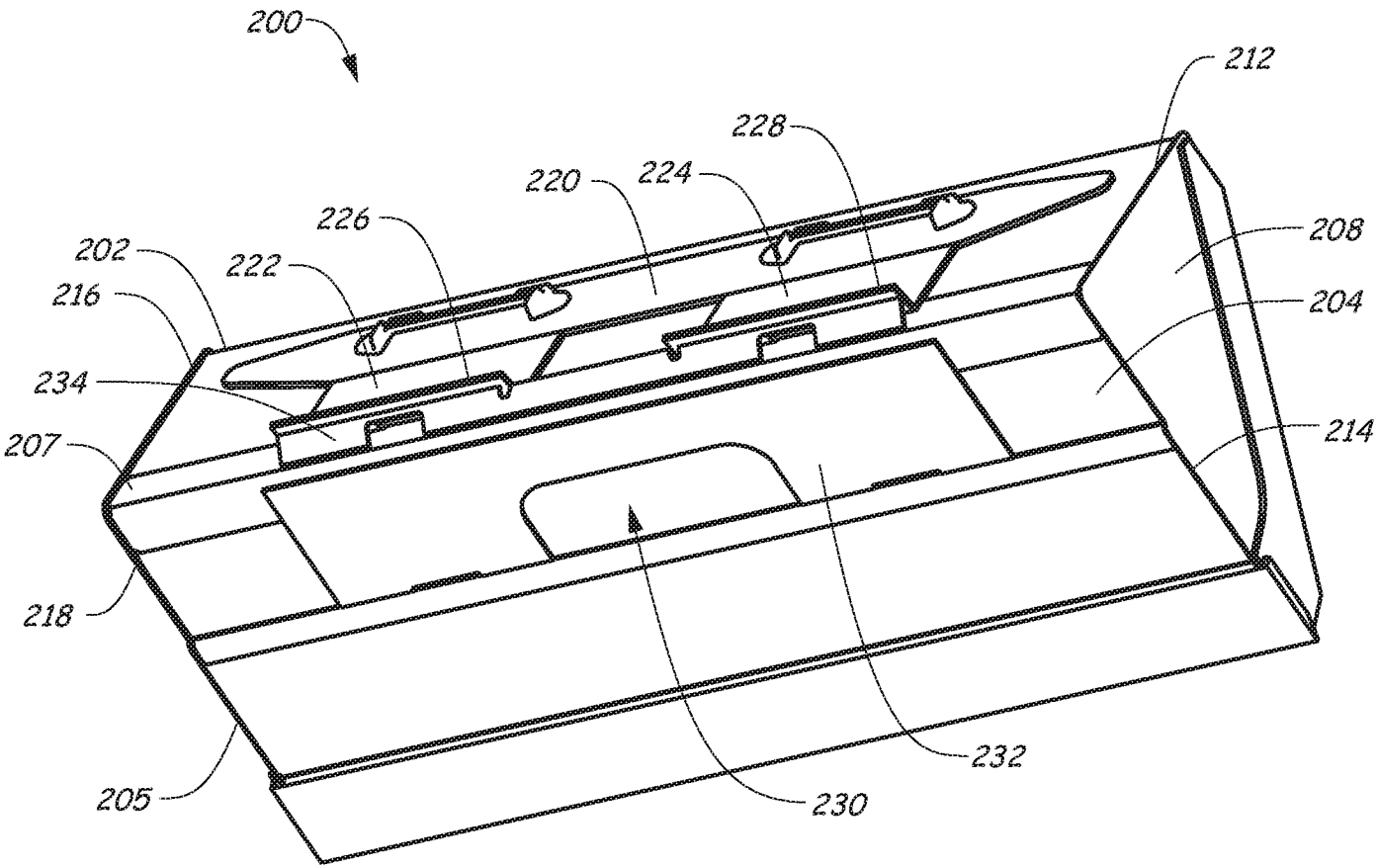
FIG. 4 is a rear bottom perspective view of a loader bucket having a two-piece brace and a cutting edge wear protector in accordance with exemplary disclosed embodiments.
Figure 5:
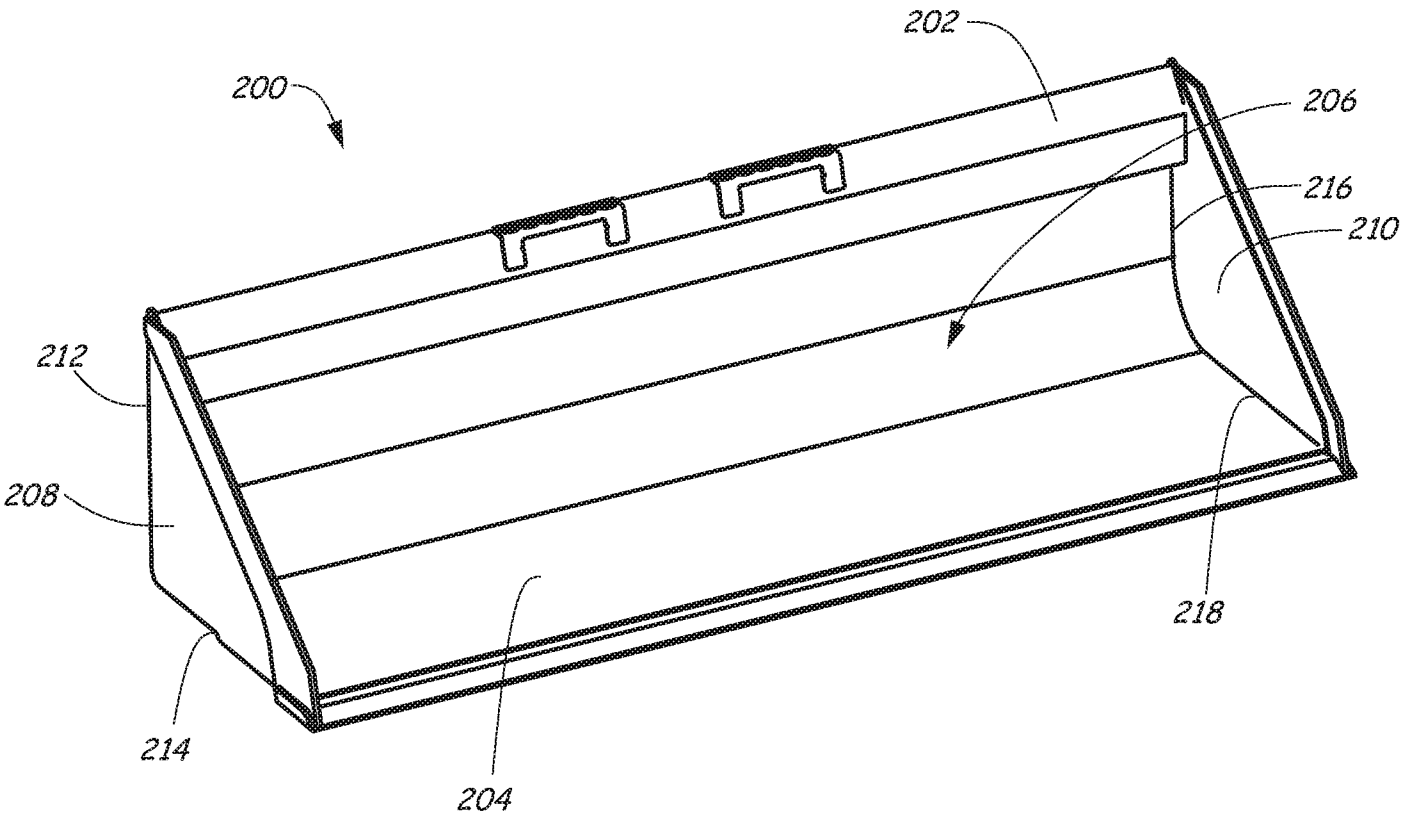
FIG. 5 is a front top perspective view of the loader bucket shown in FIG. 4.

Referring now to FIGS. 4 and 5, shown is an implement 200 in the form of a loader bucket, which can be in accordance with, and include features of, the implements illustrated in FIGS. 1-3. In particular, bucket 200 can be in accordance with the implement of FIG. 3. Bucket 200 includes a rear wall or structure 202, a bottom wall or structure 204, and first and second side walls or structures 208 and 210. Each of rear structure 202, bottom structure 204, and side structures 208 and 210 can be single continuous pieces of metal or can be formed of multiple pieces of metal. Further, each of these structures can be planar, multi-planar, and/or have other shapes in various embodiments.

Bottom structure 204 adjoins rear structure 202 at an bend region 206, which can include a reinforced L-bracket structure 207 secured to the rear and bottom structures. The L-bracket structure 207 can be welded to the rear and bottom structures. Further, a reinforcement structure 205, such as a ribbed structure, can be welded or otherwise secured to the underside of bottom structure 204. First and second side structures 208 and 210 adjoin the rear structure 202 at edges 212/216 and adjoining the bottom structure 204 at edges 214/218.

An implement carrier interface 220 is attached to rear structure 202 and is configured to mate with an implement carrier on an arm or other structure of the loader or power machine 10. Implement carrier interface 220 includes first and second engagement portions 222 and 224 providing lips 226 and 228, respectively. In exemplary embodiments, to provide additional strength along bottom edge 206 of bucket 200 to allow the bucket to withstand shock loads when the bucket encounters contact with an obstacle such as a rock, a two-piece brace 230 is provided. Two-piece brace 230 includes a first portion or piece 232 attached to and extending along a portion of bottom structure 204 of bucket 200, and a second portion or piece 234 (shown separately in FIG. 6) attached to rear structure 202 on a back side of the bucket and to a bottom portion of the implement interface 220. The second piece 234 extends along a substantial horizontal portion of the back of the bucket. For example, in some exemplary embodiments, the second piece 234 extends horizontally along at least half of the width of the bucket.

Figure 6:
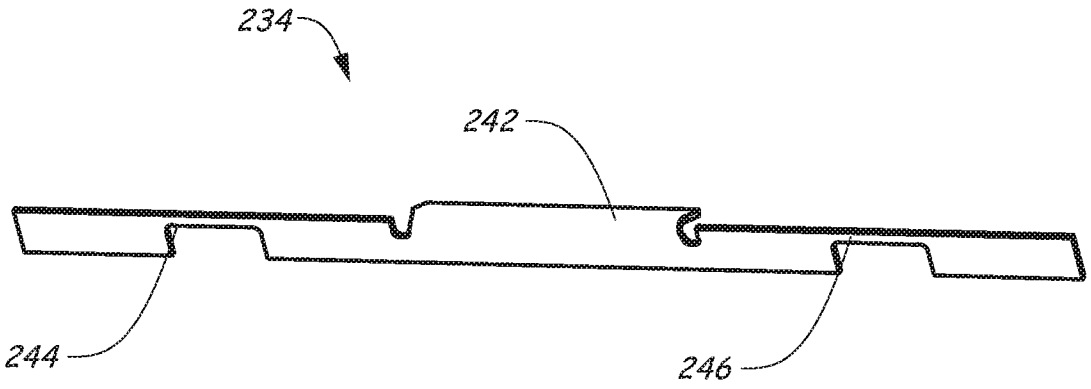
FIG. 6 is a perspective view of a piece of the two-piece brace shown in FIG. 4.

In some exemplary embodiments, second piece 234 of the two-piece brace 230 extends along portions of the rear structure 202 beneath lips 226 and 228 of implement carrier interface 220. Second piece 234 can, for example, extend the entire width between lips 226 and 228, including the width of the lips themselves, in some embodiments. Second piece 234 can be welded or otherwise attached to portions of rear structure 202 adjacent to edge 206 and/or support structure 207. In some exemplary embodiments, second piece 234 of two-piece brace 230 can be welded or otherwise mounted on support structure 207. As shown in FIG. 6, in one embodiment, second piece 234 of two-piece brace 230 includes a horizontally extending portions 240 configured and shaped to interface and be attached to rear structure 202 or support structure 207, and a tab portion 242 configured to be received in a slot (not shown) formed in rear structure 202 or support structure 207. Horizontally extending structure 240 includes first and second end portions 244 and 246 shaped and positioned to be attached under lips 226 and 228 of implement carrier interface 220. The two-piece brace 230 provides strength to the implement carrier interface 220 to prevent the interface from breaking off of the bucket due to stress and fatigue introduced during normal operation (e.g., digging, encountering objects, and the like). The two-piece brace 230 also provides strength to the bottom edge of the bucket to withstand shock load when the bucket encounters an obstacle. In addition to adding strength along the bottom of the bucket, first piece 232 also provides improved wear protection for the bucket.

Although the present invention has been described with reference to preferred embodiments, workers skilled in the art will recognize that changes may be made in form and detail without departing from the spirit and scope of the invention.

What is claimed is:

1. A power machine bucket implement, comprising:

a rear wall structure;

a bottom wall structure adjoining the rear wall structure at a bend region;

an L-bracket secured to the bottom wall structure and to the rear wall structure at the bend region between the bottom wall structure and the rear wall structure;

a two-piece brace including a first piece attached to and extending along a portion of the bottom wall structure and a second piece, separate from the first piece, attached to and extending along a horizontal portion of the back side of the rear wall structure; and an implement carrier attached to the back side of the rear wall structure, wherein the implement carrier interface includes first and second engagement portions providing first and second lip portions extending away from the back side of the rear wall structure, and wherein the second piece of the two-piece brace extends along the horizontal portion of the back side of the rear wall structure beneath the first and second lip portions of the implement carrier interface.

2. The implement of claim 1, wherein the second piece of the two-piece brace extends horizontally along at least half of the back side of the rear wall structure.

3. The implement of claim 1, wherein the first and second lip portions of the implement carrier interface are spaced apart, and wherein the second piece of the two-piece brace extends an entire width between the spaced apart first and second lip portions.

4. The implement of claim 3, wherein the second piece of the two-piece brace extends from an outer edge of the first lip portion to an outer edge of the second lip portion.

5. The implement of claim 1, wherein the second piece of the two-piece brace includes:

a tab portion configured to be received in a slot formed in the rear wall structure; and horizontally extending portions extending laterally from the tab portion and configured to interface and be attached to the rear wall structure or the L-bracket, wherein the horizontally extending portions include first and second end portions configured to be attached to first and second lip portions of an implement carrier interface.

6. The implement of claim 1, wherein the second piece of the two-piece brace is attached to the L-bracket secured to the bottom wall structure and to the rear wall structure at the bend region.

7. The implement of claim 1, wherein the second piece of the two-piece brace is attached to back side of the rear wall structure through attachment to the L-bracket secured to the bottom wall structure and to the rear wall structure at the bend region.

8. A power machine bucket implement, comprising:

a rear wall structure;

a bottom wall structure adjoining the rear wall structure at a bend region;

a first side wall structure adjoining the rear wall structure at a first edge and adjoining the bottom wall structure at a second edge;

a second side wall structure adjoining the rear wall structure at a third edge and adjoining the bottom wall structure at a fourth edge;

an implement carrier interface attached to a back side of the rear wall structure and configured to mate with an implement carrier of a power machine, the implement carrier interface including first and second engagement portions providing first and second lip portions extending away from the back side of the rear wall structure;

a two-piece brace including a first piece attached to and extending along a portion of the bottom wall structure and a second piece, separate from the first piece, attached to the back side of the rear wall structure and to a bottom portion of the implement carrier interface, wherein the second piece of the two-piece brace includes horizontally extending portions configured to interface and be attached to the rear wall structure, wherein the horizontally extending portions include first and second end portions configured to be attached under first and second lip portions of the implement carrier interface.

9. The power machine bucket implement of claim 8, and further comprising an L-bracket secured to the bottom wall structure and to the rear wall structure at the bend region between the bottom wall structure and the rear wall structure.

10. The implement of claim 9, wherein the second piece of the two-piece brace extends along a horizontal portion of the back side of the rear wall structure beneath the first and second lip portions of the implement carrier interface.

11. The implement of claim 10, wherein the first and second lip portions of the implement carrier interface are spaced apart, and wherein the second piece of the two-piece brace extends an entire width between the spaced apart first and second lip portions.

12. The implement of claim 11, wherein the second piece of the two-piece brace extends from an outer edge of the first lip portion to an outer edge of the second lip portion.

13. The implement of claim 12, wherein the second piece of the two-piece brace further includes:

a tab portion configured to be received in a slot formed in the rear wall structure; and wherein the horizontally extending portions extend laterally from the tab portion.

14. A power machine bucket implement, comprising:

a rear wall structure;

a bottom wall structure adjoining the rear wall structure at a bend region;

a first side wall structure adjoining the rear wall structure at a first edge and adjoining the bottom wall structure at a second edge;

a second side wall structure adjoining the rear wall structure at a third edge and adjoining the bottom wall structure at a fourth edge;

an implement carrier interface attached to a back side of the rear wall structure and configured to mate with an implement carrier of a power machine, the implement carrier interface including first and second engagement portions providing first and second lip portions extending away from the back side of the rear wall structure;

a two-piece brace including a first portion attached to and extending along a portion of the bottom wall structure and a second portion attached to the back side of the rear wall structure and to a bottom portion of the implement carrier interface, wherein the second portion of the two-piece brace includes:

a tab portion configured to be received in a slot formed in the rear wall structure; and horizontally extending portions extending laterally from the tab portion and configured to interface and be attached to the rear wall structure, wherein the horizontally extending portions include first and second end portions configured to be attached under first and second lip portions of the implement carrier interface.

* * * * *